US010309723B2

(12) United States Patent
Tsubata et al.

(10) Patent No.: US 10,309,723 B2
(45) Date of Patent: Jun. 4, 2019

(54) FREEZE-DRYING SYSTEM AND FREEZE-DRYING METHOD

(71) Applicant: MAYEKAWA MFG. CO., LTD., Tokyo (JP)

(72) Inventors: Kouichi Tsubata, Tokyo (JP); Shigeru Iwami, Tokyo (JP); Youichi Hiraga, Tokyo (JP); Nobuya Ishitsuka, Tokyo (JP)

(73) Assignee: MAYEKAWA MFG.CO., LTD., Tokyo (JP)

( * ) Notice: Subject to any disclaimer, the term of this patent is extended or adjusted under 35 U.S.C. 154(b) by 516 days.

(21) Appl. No.: 14/901,069

(22) PCT Filed: Jun. 25, 2014

(86) PCT No.: PCT/JP2014/066910
§ 371 (c)(1),
(2) Date: Dec. 28, 2015

(87) PCT Pub. No.: WO2014/208631
PCT Pub. Date: Dec. 31, 2014

(65) Prior Publication Data

US 2016/0153713 A1 Jun. 2, 2016

(30) Foreign Application Priority Data

Jun. 27, 2013 (JP) ..... 2013-134764

(51) Int. Cl.
*F26B 5/06* (2006.01)

(52) U.S. Cl.
CPC ..... *F26B 5/06* (2013.01)

(58) Field of Classification Search
CPC ..... F26B 5/06
(Continued)

(56) References Cited

U.S. PATENT DOCUMENTS 5,301,512 A * 4/1994 Yamamoto ..... F25C 3/04 239/2.2
6,220,048 B1 4/2001 Finan, Sr. et al.
(Continued)

FOREIGN PATENT DOCUMENTS

CN 1298085 6/2001
CN 201014887 1/2008
(Continued)

OTHER PUBLICATIONS

"Office Action of European Counterpart Application" dated Feb. 20, 2018, p. 1-p. 5.
(Continued)

*Primary Examiner* — Kenneth Rinehart
*Assistant Examiner* — Bao D Nguyen
(74) *Attorney, Agent, or Firm* — JCIPRNET

(57) ABSTRACT

An object is to provide a freeze-drying system and a freeze-drying method which can improve cleanliness and productivity. The present invention relates to a freeze-drying system in which freeze-drying is performed by sublimating moisture frozen by cooling an object. The system includes a cooling device (3) which generates cold with an air cycle in which air is used as a refrigerant, a freeze-drying chamber (2) accommodating a heat exchange unit which causes heat exchange between the refrigerant and the object, and a control unit (11) which controls a cooling capacity of the cooling device. The control unit adjusts the temperature in the freeze-drying chamber to a predetermined target temperature by controlling an amount of the cold generated in the cooling device.

6 Claims, 5 Drawing Sheets

(58) Field of Classification Search
USPC ..... 34/298, 79
See application file for complete search history.

(56) References Cited

U.S. PATENT DOCUMENTS

| | | | | |
|---|---|---|---|---|
| 6,393,850 | B1 | 5/2002 | Vanderstraeten | |
| 8,650,770 | B1 * | 2/2014 | Levy | F26B 21/001 34/219 |
| 8,758,681 | B2 * | 6/2014 | Golkowski | A61L 2/208 122/406.1 |
| 2006/0277926 | A1 * | 12/2006 | Brahmbhatt | F26B 5/06 62/64 |
| 2008/0060379 | A1 * | 3/2008 | Cheng | A01N 1/02 62/616 |
| 2011/0113644 | A1 | 5/2011 | Itou et al. | |
| 2012/0227277 | A1 * | 9/2012 | Chakravarty | F26B 5/06 34/284 |
| 2013/0111931 | A1 | 5/2013 | Grinter et al. | |

FOREIGN PATENT DOCUMENTS

| | | |
|---|---|---|
| CN | 201014888 | 1/2008 |
| CN | 201297823 | 8/2009 |
| CN | 102089606 | 6/2011 |
| EP | 0546931 | 6/1993 |
| JP | 52-130055 | 11/1977 |
| JP | 2001-105844 | 4/2001 |
| JP | 2003-194459 | 7/2003 |
| JP | 2003307384 | 10/2003 |
| JP | 3869297 | 1/2007 |
| JP | 2010-502932 | 1/2010 |
| JP | 2013-505425 | 2/2013 |
| WO | 2008085208 | 7/2008 |
| WO | 2011034980 | 3/2011 |

OTHER PUBLICATIONS

"International Search Report (Form PCT/ISA/210)", dated Sep. 30, 2014, pp. 1-6.
"Written Opinion of the International Searching Authority" of PCT/JP2014/066910, dated Sep. 30, 2014, with English translation thereof, p. 1-p. 14.
"Office Action of China Counterpart Application" , dated Jul. 21, 2016, p. 1-p. 5.
"Search Report of Europe Counterpart Application" , dated Aug. 19, 2016, p. 1-p. 9.
"Office Action of European Counterpart Application," dated Sep. 24, 2018, p. 1-p. 5.
"Office Action of India Counterpart Application," dated Jan. 23, 2019, pp. 1-5.

* cited by examiner

FREEZE-DRYING SYSTEM AND FREEZE-DRYING METHOD

CROSS-REFERENCE TO RELATED APPLICATION

This application is a 371 application of an International PCT application serial no. PCT/JP2014/066910, filed on Jun. 25, 2014, which claims the priority benefits of Japan Application No. JP 2013-134764, filed on Jun. 27, 2013. The entirety of each of the above-mentioned patent applications is hereby incorporated by reference herein and made a part of this specification.

TECHNICAL FIELD

The present invention relates to a technical field of a freeze-drying system and a freeze-drying method for performing freeze-drying on an object requiring cleanliness.

BACKGROUND

Freeze-drying has been known as one type of processing foods and chemicals. In the freeze-drying, the object disposed in a freeze-drying chamber is cooled to freeze moisture in the object. Then, the frozen moisture is sublimated by decompressing and heating the freeze-drying chamber, and the moisture thus emitted into an atmosphere is collected by a cold trap cooled in advance, whereby the object is dried.

FIG. 5 shows an example of a system which implements the freeze-drying. FIG. 5 is a schematic view showing an overall configuration of a conventional freeze-drying system 100'. In particular, this example shows a system which can implement the freeze-drying with a simple configuration by generating cold by a condensing unit as a single heat source device.

The freeze-drying system 100' includes: a freeze-drying chamber 2 which includes a pipe shelf 1 on which the object is disposed; a cooling device 3 as the condensing unit which generates the cold; a cold trap 4 which collects the sublimated moisture; and a heat exchange unit 5 in which a first refrigerant flowing in the cooling device 3 and a second refrigerant flowing in the pipe shelf 1 exchange heat. A valve 7*a* for adjusting a flowrate of the first refrigerant is disposed on a circulation line 6 in which the first refrigerant circulate. A bypass line 8*a* passing through the heat exchange unit 5 and a bypass line 8*b* which leads into the cold trap 4 are branched from the circulation line 6. Valves 7*b* and 7*c* for adjusting an amount of the first refrigerant flowing in are respectively disposed on the bypass lines 8*a* and 8*b*.

A circulation pump 10 for permitting the circulation of the second refrigerant is disposed on a circulation line 9 in which the second refrigerant circulates.

For example, a refrigerant such as CFC or ammonia may be used as the first refrigerant, and anti-freezing solution or oil may be used as the second refrigerant.

A controller 11, as a control unit, implements an operation of the freeze-drying system 100'. More specifically, an open-close state of the valves 7*a* to 7*c*, an amount of generated cold in the cooling device 3, and an operation state of the circulation pump 10 are controlled based on a control signal transmitted from the controller 11.

First of all, in the freeze-drying system 100', the valves 7*a* and 7*b* are set to be in the opened state so that the first refrigerant, including the cold from the cooling device 3, is guided to the heat exchange unit 5, whereby the second refrigerant flowing in the pipe shelf 1 is cooled. Thus, the object, disposed on the pipe shelf 1, receives the cold from the second refrigerant to be frozen.

When the object is thus frozen, the cold trap 4 may be cooled at the same time by setting the valve 7*c* to be in the opened state.

Once the freezing of the object is completed, the freeze-drying chamber 2, including the object, is decompressed by an unillustrated decompressing unit (such as a vacuum pump), whereby the frozen moisture in the object is sublimated. Here, the sublimation of the moisture may be facilitated by heating the second refrigerant with a heating unit such as a heater, in addition to the decompression with the decompressing unit.

The moisture emitted into the atmosphere by the sublimation in the freeze-drying chamber 2 is collected by the cold trap 4 coupled to the freeze-drying chamber 2. The moisture accumulated in the cold trap 4 is discharged to the outside when the freeze-drying is completed.

For example, Patent Document 1 discloses a system of performing freeze-drying by using the cold generated in the cooling device 3 through a plurality of refrigerants. In Patent Document 1, the system configuration is simplified in such a manner that a single cooling device can further cover the cooling of a condenser in the system.

Generally, the freeze-drying needs to cool the object to an extremely low temperature, and thus requires a long freezing period. Thus, higher productivity has been called for. To achieve this, Patent Document 2 discloses a technique of directly supplying an extremely low temperature fluid such as liquid nitrogen into the freeze-drying chamber, in addition to the cooing by the cooling device, to facilitate the cooling to thereby shorten the freezing period.

CITATION LIST

Patent Literature

Patent Document 1: Japanese Translation of PCT Application No. 2010-502932

Patent Document 2: Japanese Translation of PCT Application No. 2013-505425

SUMMARY

Technical Problem

The freezing in the freeze-drying is a process of forming an ice crystal (seed crystal) through growing of dendritic ice after forming an origin known as the nucleus in the object. When the atmosphere includes a suspended particle or a faulty portion of a container, the ice crystal is formed with these as the nucleus. However, to perform the freeze-drying on an object such as food or chemical requiring hygiene, the nucleus needs to be formed from the moisture by supercooling the moisture. The size of the nucleus depends on the supercooling temperature, to be smaller with a lower supercooling temperature. The smaller nucleus leads to a larger resistance against a vapor flow, which results in a longer freezing cycle. Thus, when the cooling is simply facilitated by supplying extremely low temperature fluid as in Patent Document 2, there is a problem in that the freezing cycle becomes long due to the reason described above to increase the production cost.

In Patent Document 2, liquid nitrogen needs to be supplied from the outside with a storing unit such as a gas cylinder for example. Thus, there is a problem of a complicated system configuration and a high running cost. This problem is particularly eminent when expensive liquid nitrogen with excellent cleanliness is used. The cleanliness of the fluid may be ensured by a sterilizer. However, general sterilizers cannot be used in an extremely low temperature area involving liquid nitrogen and the like.

Thus, in view of the problems described above, an object of the present invention is to provide a freeze-drying system and a freeze-drying method which can improve cleanliness and productivity with a simple system.

Solution to Problem

To achieve the object, a freeze-drying system according to the present invention is a freeze-drying system in which freeze-drying is performed by sublimating moisture frozen by cooling an object, and collecting the sublimated moisture with a cold trap. The system includes a cooling device which generates cold with an air cycle in which air is used as a refrigerant, a freeze-drying chamber accommodating a heat exchange unit which causes heat exchange between the refrigerant and the object, and a control unit which controls a cooling capacity of the cooling device. The control unit adjusts the temperature in the freeze-drying chamber to a predetermined target temperature by controlling an amount of the cold generated in the cooling device.

According to the present invention, the cold is generated with the cooling device including the air cycle. Thus the high freezing capacity required for the freezing can be obtained by a single heat source device, whereby the freeze-drying can be implemented with a simple configuration. In particular, in addition to the capability of solely providing the high freezing capacity, the cooling device using the air cycle covers a wider temperature range and thus can perform flexible temperature control so that favorable productivity can be achieved.

In one aspect of the present invention, the control unit freezes the object by precooling the freeze-drying chamber by setting the target temperature to a first temperature, and then by setting the target temperature to a second temperature lower than the first temperature.

In the present aspect, the object is frozen through a plurality of stages, whereby the period required for the freezing can be effectively shortened, whereby higher productivity can be achieved. For example, in an early stage of freezing, a relatively high first target temperature may be set so that a nucleus of an appropriate size is formed. Then, a relatively low second target temperature may be set so that the nucleus grows and the ice crystal is formed. The first temperature is set as a temperature suitable for forming a nucleus of an appropriate size. The second temperature is set as a temperature suitable for growing the nucleus. Thus, with the temperature control through a plurality of stages, the period required for the freezing can be effectively shortened, whereby higher productivity can be achieved.

In another aspect, the freeze-drying system may further include a cold air supplying mechanism which supplies precooled air into the freeze-drying chamber.

In the present aspect, the precooled air is supplied into the freeze-drying chamber, in addition to the cold generated in the cooling device, whereby higher cooling capacity can be achieved. Thus, the period required for the freezing can be further shortened, whereby higher productivity can be achieved.

In this case, the cold air supplying mechanism may include an outer air intake unit which takes in outer air, a cooling unit which cools the outer air by performing the heat exchange between the taken outer air and the refrigerant, and a blower unit which blows the cooled outer air into the freeze-drying chamber.

In the present aspect, part of the cold generated in the cooling device and the outer air can be used so that the cooled outer air is transmitted to the freeze-drying chamber, whereby the freezing period can be shortened with a simple system configuration.

Also in this case, the outer air intake unit may take in the outer air through a sterilizer to clean the outer air.

In the present aspect, the outer air at a normal temperature is cleaned by the sterilizer and then is cooled. Thus, the cold air with excellent hygiene can be generated with a general sterilizer which is difficult to use in the extremely low temperature area. Thus, the freezing period involving the clean cold air can be shortened with a low cost.

When the temperature of the outer air cooled by the cooling unit is within a temperature range in which the sterilizer can operate, the sterilizer may be disposed on a downstream side of the cooling unit so that the cooled outer air is sterilized and then is transmitted to the freeze-drying chamber. The sterilizer may be disposed on a downstream side of the blower unit (between the freeze-drying chamber and the blower unit). Thus, the cold air that has passed through the blower unit as an operating unit can be sterilized, whereby cleaner cold air can be supplied to the freeze-drying chamber.

The cold air supplying mechanism may include an air supply line through which air, as the refrigerant that circulates in the air cycle, is partially introduced into the freeze-drying chamber.

In the present aspect, the air as the refrigerant circulating in the air cycle is directly introduced into the freeze-drying chamber. Thus, the cooling of the freeze-drying chamber can be facilitated, and the freezing period can be shortened. This is advantageous in that the period can be shortened with a simple configuration of providing the air supply line through which the air circulating in the air cycle is introduced into the freeze-drying chamber.

In this case, in the air cycle, the outer air taken in through the sterilizer may be used as the refrigerant.

In the present aspect, the outer air taken into the air cycle is cleaned in advance by the sterilizer, whereby extremely clean cold air can be generated. In the aspect of including the blower unit, a rotating device such as a fan for example may be used as the blower unit. However, such an operating portion might generate fine particles due to friction and the like. This aspect includes no such operating portion and thus can correspond to a case where extremely high standard of cleanliness has to be met.

When the temperature of the cold air flowing in the air supply line is within the temperature range in which the sterilizer can operate, the sterilizer may be disposed on the supply line so that the cold air extracted from the air cycle is sterilized and then is transmitted to the freeze-drying chamber. Thus, the adverse effect of the fine particles generated by rotating devices used in a compressing step and an expanding step can be eliminated, whereby even higher cleanliness of the cold air can be ensured.

To achieve the object, a freeze-drying method according to the present invention is a freeze-drying method in which freeze-drying is performed by sublimating moisture frozen by cooling an object, and collecting the sublimated moisture with a cold trap. The method includes precooling the freeze-drying chamber by setting a temperature in the freeze-drying chamber to a first temperature, freezing the object by setting the temperature in the freeze-drying chamber to a second temperature lower than the freeze-drying chamber, and drying performed through sublimating an ice crystal formed in the object and collecting the moisture emitted into an atmosphere with the cold trap.

In one aspect of the present invention, cooling in the freeze-drying chamber is facilitated by supplying precooled air into the freeze-drying chamber.

In this case, air supplied to the freeze-drying chamber is precooled through heat exchange between air taken in from outside and cold generated in the air cycle.

In addition, air circulating in the air cycle is partially introduced into the freeze-drying chamber.

The freeze-drying method according to the present invention can be favorably implemented with a freeze-drying system (including the various aspects described above).

Advantageous Effects

In the present invention, the cold is generated with the cooling device including the air cycle. Thus, the high freezing capacity required for the freezing can be obtained by a single heat source device, whereby the freeze-drying can be implemented with a simple configuration.

In particular, in addition to the capability of solely providing the high freezing capacity, the cooling device using the air cycle covers a wide temperature range and thus can perform flexible temperature control so that favorable productivity can be achieved.

DETAILED DESCRIPTION

Preferred embodiments of the present invention shown in the accompanying drawings will now be described in detail. It is intended, however, that dimensions, materials, shapes, relative positions, and the like of components described in the embodiments shall be interpreted as illustrative only and not limitative of the scope of the present invention unless otherwise specified.

(First Embodiment)

Figure 1:
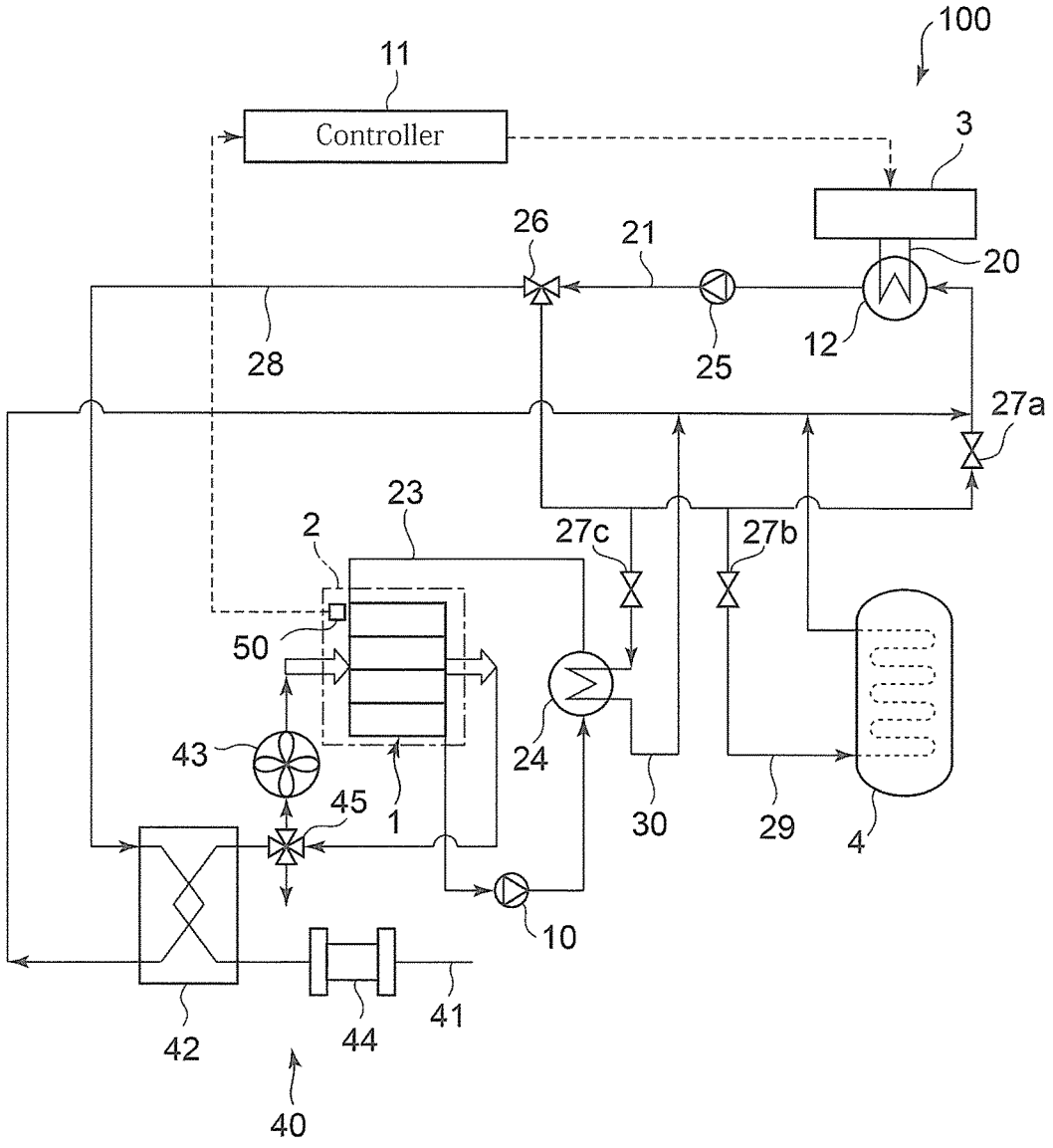
FIG. 1 is a schematic view showing an overall configuration of a freeze-drying system according to a first embodiment.
Figure 5:
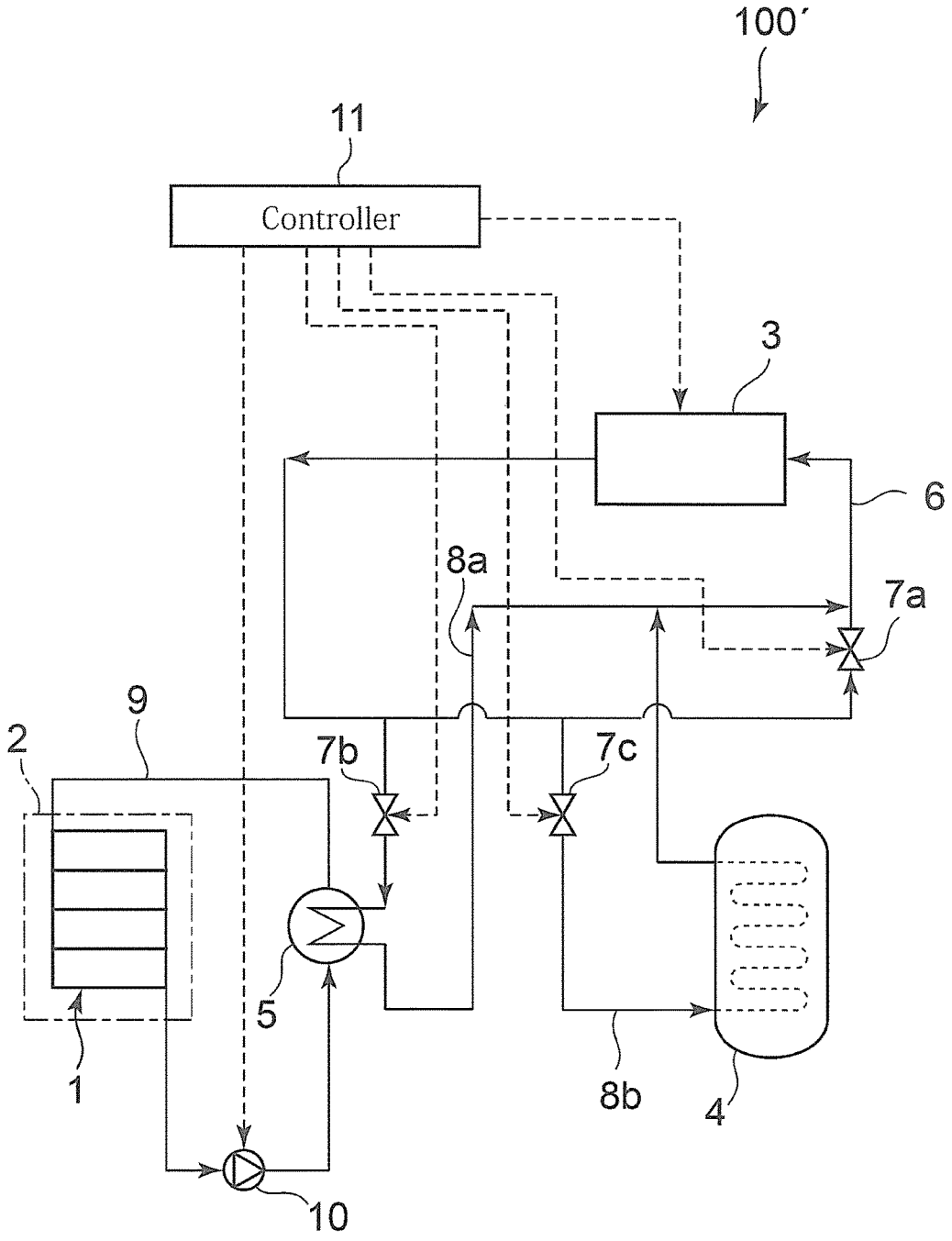
FIG. 5 (RELATED ART)
FIG. 5 is a schematic view showing an overall configuration of a conventional freeze-drying system.

FIG. 1 is a schematic view showing an overall configuration of a freeze-drying system 100 according to a first embodiment. Components in FIG. 1 that are the same as those in FIG. 5 showing a conventional example are denoted with the same reference numerals and a redundant description will be omitted as appropriate.

The freeze-drying system 100 includes a cooling device 3 including an air cycle in which air is used as a refrigerant (hereinafter, referred to as "first refrigerant" to be distinguished from other refrigerants). With the air used as the refrigerant, the air cycle features an excellent freezing capacity and a capability of covering a wide temperature range. The system according to the present embodiment can efficiently perform freeze-drying with a single heat source device by using cold thus generated in the air cycle, whereby a simple configuration can be achieved.

The cold generated in the cooling device 3 is transmitted to a freeze-drying chamber 2 including the object, through heat exchange. More specifically, the system includes: a first circulation line 20 in which the first refrigerant circulates in the cooling device 3; a second circulation line 21 in which a second refrigerant exchanges heat with the first refrigerant; and a third circulation line 23 in which a third refrigerant exchanges heat with the second refrigerant. The heat exchange between the first refrigerant and the second refrigerant takes place in a first heat exchange unit 12. The heat exchange between the second refrigerant and the third refrigerant takes place in a second heat exchange unit 24. The third refrigerant passes through the freeze-drying chamber 2, and exchanges heat with the object in the freeze-drying chamber 2 as described later, whereby the cold can be supplied to the object.

As described above, the various refrigerants to be used are each configured to circulate in a closed circulation line. Thus, no refrigerant needs to be supplied from outside, whereby a low running cost can be achieved with a small maintenance load.

A circulation pump 25 for pumping the second refrigerant, a three-way valve 26, and a valve 27 are disposed on the second circulation line 21. As described later, the three-way valve 26 is used for partially supplying the second refrigerant into a cold air supplying mechanism 40 from the second circulation refrigerant line 21 through a first bypass line 28, with an open-close state controlled by a controller 11. Furthermore, the controller 11 controls an aperture of the valve 27 to adjust a flowrate of the second refrigerant in the circulation refrigerant line 21.

A second bypass line 29 which leads to a cold trap 4, and a third bypass line 30 which leads to the second heat exchange unit 24 in which the heat exchange between the second refrigerant and the third refrigerant takes place are branched from the second circulation refrigerant line 21. Valves 27*b* and 27*c* are respectively disposed on the second bypass line 29 and the third bypass line 30, and enables supplying of the second refrigerant from the second circulation line 21 with the aperture adjusted by the controller 11.

The freeze-drying chamber 2 accommodates a pipe shelf 1 on which the object is disposed. The third circulation line 23 is routed to pass through the pipe shelf 1. Thus, the object on the pipe shelf 1 receives the cold from the third refrigerant through the pipe shelf 1 to be cooled.

Figure 2A:
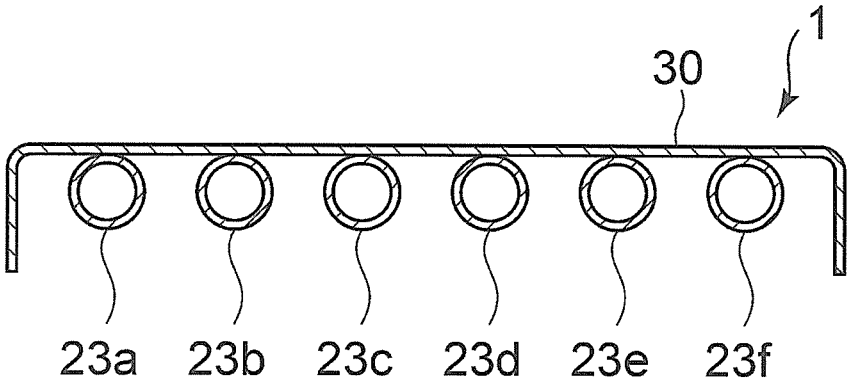
FIGS. 2(*a*) and 2(*b*) are schematic views showing a cross-sectional configuration of a pipe shelf.
Figure 2B:
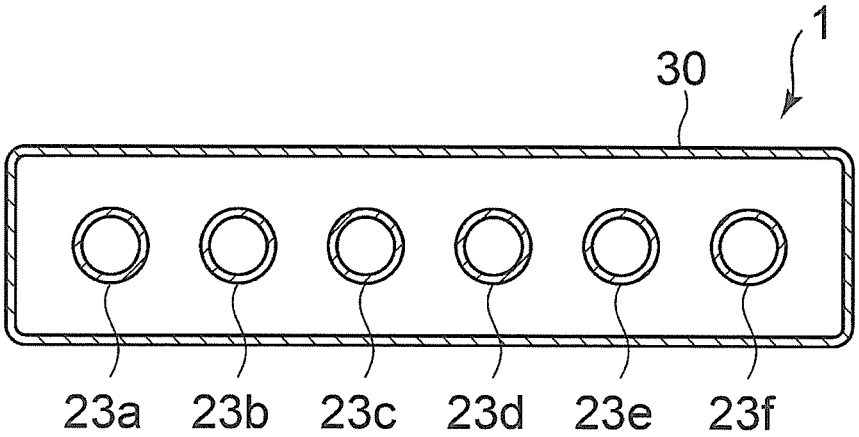

FIGS. 2(*a*) and 2(*b*) are schematic views showing a cross-sectional configuration of the pipe shelf 1. At a portion around the pipe shelf 1, the third circulation refrigerant line 23 is branched into a plurality of cooling pipes 23*a* to 23*f* which are arranged along a disposing surface 30 for the object. As described above, an attempt to improve the heat exchange efficiency is facilitated with an increased contact area between the object disposed on the pipe shelf 1 and the cooling pipes 23*a* to 23*f*.

FIGS. 2(*a*) and 2(*b*) show two configuration examples. FIG. 2(*a*) shows a configuration in which a metal plate, on which the object can be disposed, is laid on the plurality of cooling pipes 23*a* to 23*f* in which the third refrigerant flows, and the cooling pipes 23*a* to 23*f* are arranged closely to the disposing surface 30 for the object. In an example shown in FIG. 2(*b*), the plurality of cooling pipes 23*a* to 23*f* are arranged in the metal plate with a certain amount thickness.

A feature of the present embodiment is that, with the cold air supplying mechanism 40, a freezing period of the object in the freeze-drying chamber 2 is shortened, whereby higher productivity is achieved. The cold air supplying mechanism 40 includes: an outer air intake unit 41 which takes in outer air; a cooling unit 42 which cools the outer air by performing the heat exchange between the taken outer air and the refrigerant; a blower unit 43 which blows the cooled outer air into the freeze-drying chamber 2.

The outer air intake unit 41 takes in the outer air through a sterilizer 44, whereby cleanliness of the freeze-drying chamber 2 is ensured. General sterilizers are difficult to operate in an extremely low temperature area. Thus, the sterilizer 44 is used before the outer air is cooled, whereby the cleanliness can be ensured with a low cost.

The cooling unit 42 includes a cooling unit 42. In the cooling unit 42, the outer air cleaned by the sterilizer 44 exchanges heat with the second refrigerant guided to the first bypass line 28 from the three-way valve 26, whereby cold air is generated. The cold air is blown into the freeze-drying chamber 2 by the blower unit 43, a fan, and facilitates the cooling of the object.

As described above, in the cold air supplying mechanism 40 of the present embodiment, the cold air can be generated by partially using the cold generated in the air cycle. Thus, a configuration for supplying an extremely low temperature refrigerant from the outside is not required, which is the case in Patent Document 2, whereby the freezing period can be shortened with a simple configuration.

The controller 11is a control unit for controlling an operation of the freeze-drying system 100, and has a function of operating the system by transmitting a control signal to various portion of the system. The freeze-drying chamber 2 includes a temperature sensor 50. The controller 11 controls an output of the cooling device 3 in such a manner that the temperature sensor 50 detects a target value.

Figure 3:
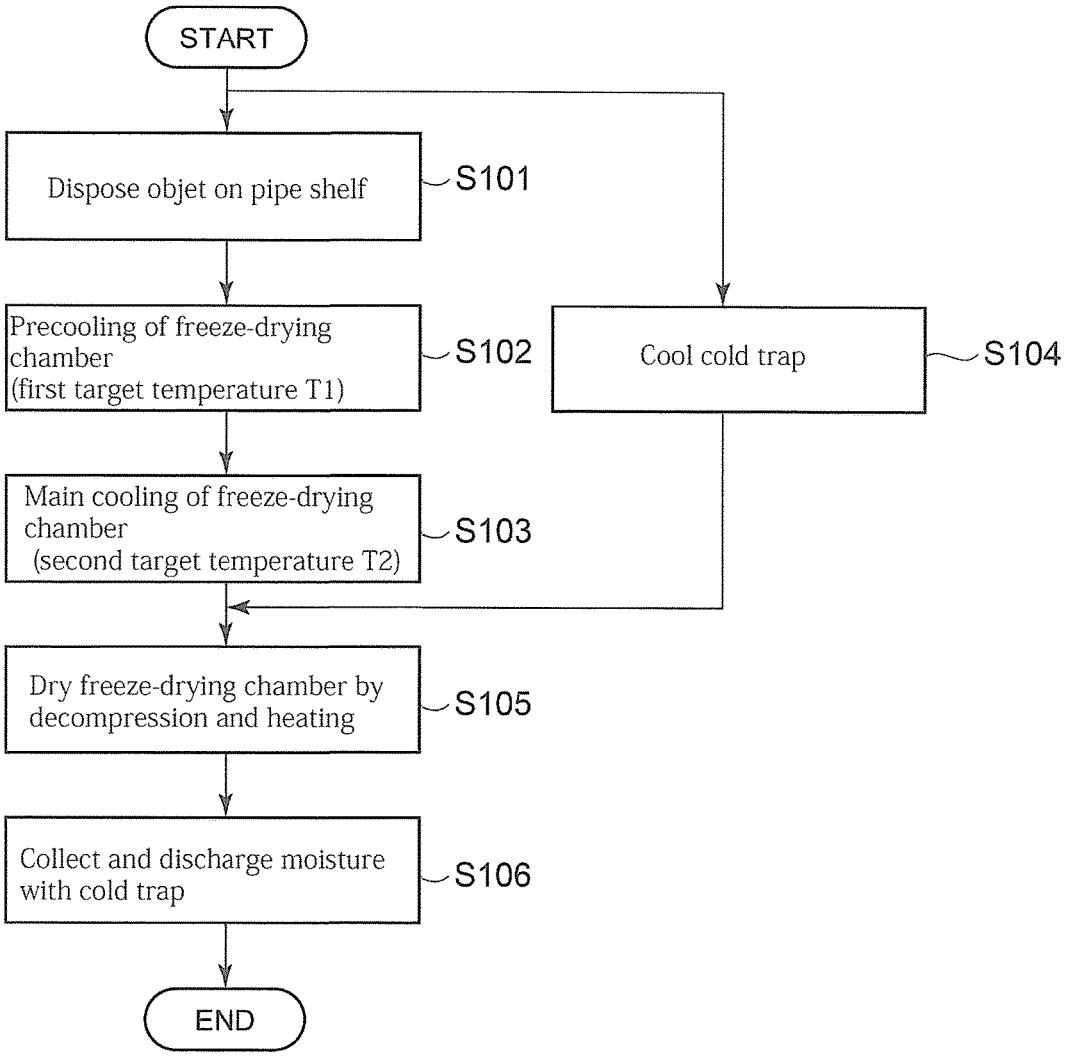
FIG. 3 is a flowchart showing an operation of the freeze-drying system according to a first embodiment.

A specific operation of the freeze-drying system is described with reference to FIG. 3. FIG. 3 is a flowchart showing an operation of the freeze-drying system 100 according to the first embodiment.

First of all, the object is disposed on the pipe shelf 1 in the freeze-drying chamber 2 (step S101). Here, the freeze-drying chamber 2 is at a normal temperature. The controller 11 starts the cooling device 3 and switches a valve 27*a* to an opened state. Thus, the cooling device 3 is controlled in such a manner that the cold generated in the air cycle is delivered through the second refrigerant flowing in the second circulation line 21 and the third refrigerant flowing through the third circulation line 23, whereby the freeze-drying chamber 2 is set to be at a first target temperature T1 (step S102).

The first target temperature T1 is set in advance as a temperature with which an appropriate size of a nucleus required for freezing the object can be obtained. The freezing is a process of forming an ice crystal (seed crystal) through growing of dendritic ice after forming an origin known as the nucleus. In the present embodiment, the object is supposed to be chemicals requiring high cleanliness. Thus, there is no suspended particle and the like which may server as the nucleus in the atmosphere in the freeze-drying chamber 2. Thus, the moisture in the object is super cooled to generate the nucleus.

The size of the nucleus depends on the supercooling temperature, to be smaller with a lower supercooling temperature. The smaller nucleus leads to a larger resistance against a vapor flow, which results in a longer freezing cycle. Thus, in step S102, the target temperature is set to be the first target temperature T1 which is relatively high, so that a nucleus of an appropriate size is generated.

When the temperature in the freeze-drying chamber 2 reaches the first target temperature T1, the controller 11 changes the target temperature to a second target temperature T2 lower than the first target temperature T1 (step S103). Thus, the nucleus formed in step S102 grows so that the ice crystal is formed, whereby freezing of the object is performed. The second target temperature T2 is set is advance as a temperature suitable for growing the nucleus.

As described above, the following process is performed for freezing the object. Specifically, in an early stage of freezing, the relatively high first target temperature T1 is set so that the nucleus of an appropriate size is formed. Then, the relatively low second target temperature T2 is set so that the nucleus grows and the ice crystal is formed. Thus, the period required for the freezing can be effectively shortened, whereby higher productivity can be achieved.

In the present embodiment, the first target temperature T1 is about −40° C., and the second target temperature T2 is about −80° C. The first target temperature T1 and the second target temperature T2, with a large temperature difference, can be obtained by a single cooling device because the air cycle is employed in the cooling device 3 which generated the cold.

In steps S102 and S103 described above, the controller 11 operates the cold air supplying mechanism 40 to facilitate the cooling, whereby each target temperature can be achieved with a shorter period of time. More specifically, through switching the three-way valve 26, the second refrigerant is introduced into the cooling unit 42 from the second circulation line 21 through the first bypass line 28, and the outer air intake unit 41 starts taking in air, whereby the cold air is generated. The cold air thus generated is supplied to the freeze-drying chamber 2 by activating the fan as the blower unit 43.

The air used for cooling in the freeze-drying chamber 2 is discharged to the outside through a four-way valve 45.

In the present embodiment, while steps S102 and S103 are in progress, valve opening control is performed to cool a cold trap (step S104). The cold trap is cooled to a temperature low enough to collect the moisture sublimated from the object in a drying step described later.

When the freezing of the object is completed, the controller 11 operates an unillustrated decompression device to decompress the freeze-drying chamber 2. Thus, the frozen moisture in the object is sublimated whereby the object is dried (step S105). Here, the sublimation may be facilitated by heating the third refrigerant with a heating unit such as a heater provided in the freeze-drying chamber 2.

When the third refrigerant is heated with the heating unit, oil which is less likely to be degraded by heat may be used as the third refrigerant.

The sublimated moisture is emitted into the atmosphere of the freeze-drying chamber 2 to be collected by the cold trap 4 in communication with the freeze-drying chamber 2. The moisture, collected by the cold trap 4, is accumulated as ice and is discharged to the outside after the drying step is completed (step S106).

The freeze-drying, which has conventionally required 24 hours of freezing time, can be completed in few hours (for example, four hours) by employing the present invention. Thus, it has been provided that a large improvement of productivity is obtained.

As described above, the freeze-drying system 100 according to the present embodiment generates the cold with the cooling device 3 including the air cycle. Thus the high freezing capacity required for the freezing can be obtained by a single heat source device, whereby the freeze-drying can be implemented with a simple configuration. In particular, in addition to the capability of solely providing the high freezing capacity, the cooling device 3 using the air cycle covers a wider temperature range and thus can perform flexible temperature control so that favorable productivity can be achieved.

(Second Embodiment)

A second embodiment employs a cold air supplying mechanism 60 having a configuration different from that in the first embodiment described above. In the present embodiment, components that are the same as the counterparts in the first embodiment are denoted with the same reference numerals, and a redundant description is omitted as appropriate.

Figure 4:
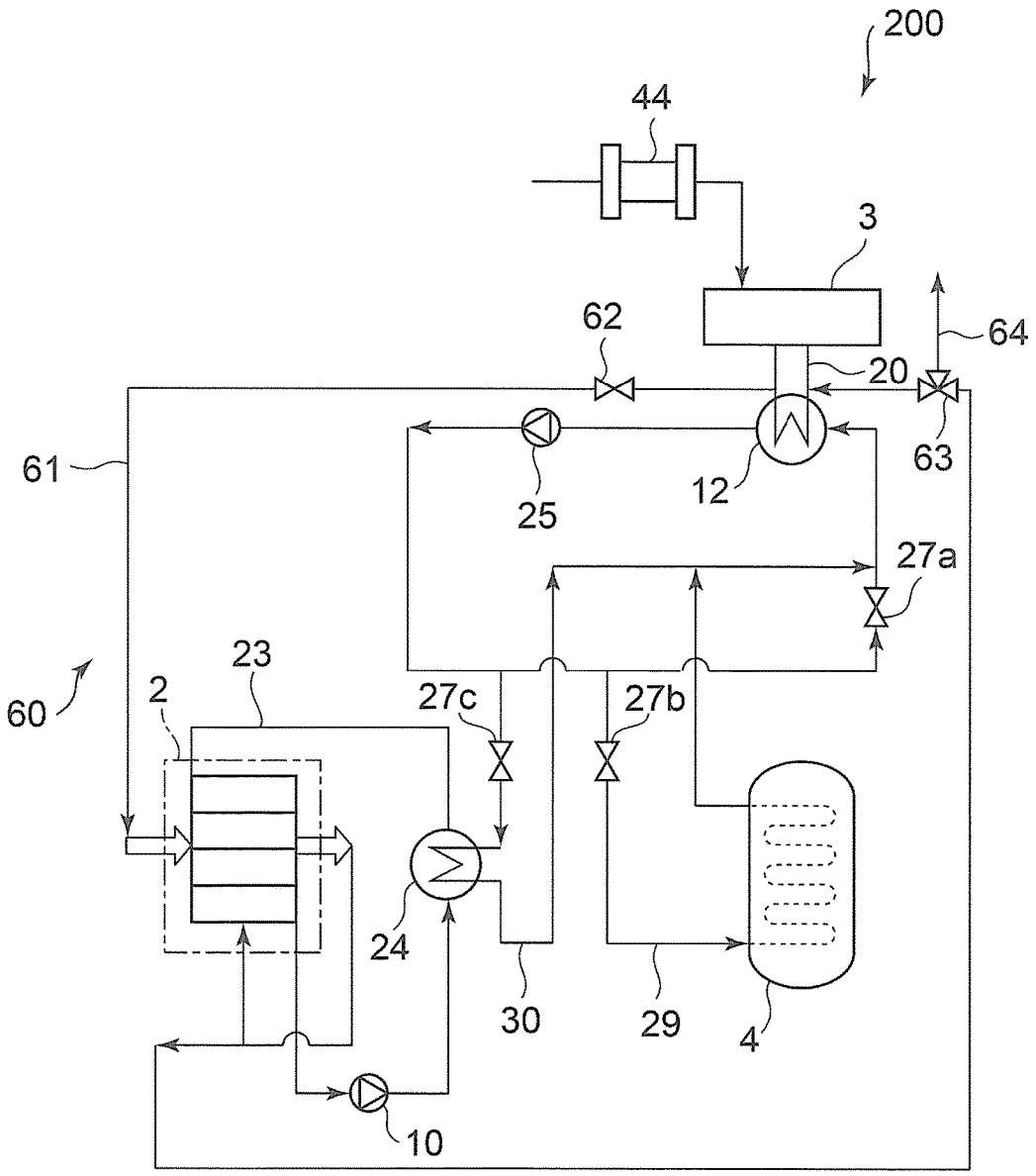
FIG. 4 is a schematic view showing an overall configuration of a freeze-drying system according to a second embodiment.

FIG. 4 is a schematic diagram illustrating an overall configuration of a freeze-drying system 200 according to the second embodiment.

The cold air supplying mechanism 60 according to the present embodiment includes an air supply line 61 through which the air, as the first refrigerant that circulated in the air cycle in the cooling device 3, is partially guided into the freeze-drying chamber 2. The air cycle uses the clean air, as the outer air taken in from the outside through the sterilizer 44, and typically includes a compressing step, a cooling step, an expanding step, and a heat exchanging step. The air supply line 61 is connected between the expanding step and the heat exchanging step, and is configured to enable extraction of the cold first refrigerant.

A valve 62, with which an aperture can be adjusted by the controller 11, is disposed on the air supply line 61, whereby the flowrate of the first refrigerant to be extracted can be controlled.

In the second embodiment, the second refrigerant and the third refrigerant circulate in the closed circulation lines as in the first embodiment, and thus need not to be supplied from the outside. On the other hand, the air, as the first refrigerant, is taken in as the outer air through an intake port, and is discharged to the outside through a discharge line 64 and a three-way valve 63 after being used for cooling the object in the freeze-drying chamber 2. For an object of a certain type, the required high cleanliness can be ensured by discharging the first refrigerant that has been taken in through the sterilizer 44 and then used, to prevent the first refrigerant from being repeatedly used.

In the first embodiment, a rotating device such as a fan for example is used as the blower unit 43. Such a rotating device includes an operating portion, and thus might somewhat generate fine particles due to friction and the like. In the present embodiment, only process required in this context is introducing of the cold air flowing in the air cycle into the freeze-drying chamber through the air supply line 61, and thus no operating portion is involved, whereby high cleanliness can be achieved.

The compressing step and the expanding step in the air cycle may involve rotating devices such as a turbine, and thus the rotating devices might introduce the fine particles into the cold air to be supplied to the freeze-drying chamber. Thus, preferably, a sterilizer is further provided on an air supply line in which the cold air to be supplied to the freeze-drying chamber flows (that is on a previous stage of the freeze-drying chamber), thus even higher cleanliness of the cold air to be supplied to the freeze-drying chamber can be ensured.

As described above, the second embodiment can achieve both high speed cooling in the freeze-drying chamber 2 and high cleanliness in the freeze-drying chamber 2 with a simple configuration.

In the present embodiment, the circulation line for the first refrigerant forms an opened loop, and thus the circulating amount of the first refrigerant might fluctuate. The circulation amount of the first refrigerant, which might take various values depending on the generation amount of the cold and operation conditions, may be set in the cooling device in such a manner that an intake amount of the outer air at the intake port and a discharge amount to the outside are balanced by adjusting the apertures of the intake and discharge valves with the controller 11.

INDUSTRIAL APPLICABILITY

The present invention can be applied to a freeze-drying system and a freeze-drying method for performing freeze-drying on an object requiring cleanliness.

The invention claimed is:

1. A freeze-drying system in which freeze-drying is performed by sublimating moisture frozen by cooling an object, and collecting the sublimated moisture with a cold trap, the freeze-drying system comprising:

a cooling condenser which generates cold with an air cycle in which air is used as a first refrigerant;

a freeze-drying chamber accommodating a heat exchange unit which causes heat exchange between a third refrigerant and the object;

a cold air supplying mechanism which supplies precooled air into the freeze-drying chamber;

a controller which controls a cooling capacity of the cooling condenser;

a first circulation line in which the first refrigerant circulates in the cooling condenser;

a second circulation line in which a second refrigerant that exchange heat with the first refrigerant circulates; and a third circulation line in which the third refrigerant that exchange heat with the second refrigerant circulates, wherein the heat exchange unit includes a pipe shelf on which the object is disposed;

the third circulation line being routed to pass through the pipe shelf such that the object receives the cold from the third refrigerant through the pipe shelf;

the cold air supplying mechanism includes:

an outer air intaker which takes in outer air;

a cooler which cools the outer air by performing the heat exchange between the taken outer air and the second refrigerant; and a blower which blows the cooled outer air into the freeze-drying chamber, and the controller adjusts a temperature in the freeze-drying chamber to a predetermined target temperature by controlling an amount of the cold generated in the cooling condenser.

2. The freeze-drying system according to claim 1, wherein the controller performs first cooling of cooling the freeze-drying chamber to a first temperature by setting the target temperature to the first temperature and supercools moisture contained in the object in the freeze-drying chamber to generate an ice nucleus, and then performs second cooling which cools the freeze-drying chamber to a second temperature lower than the first temperature by setting the target temperature to the second temperature and grows the ice nucleus of the object in the freeze-drying chamber to generate an ice crystal.

3. The freeze-drying system according to claim 1, wherein the outer air intaker takes in the outer air through a sterilizer to clean the outer air.

4. A freeze-drying method in which freeze-drying is performed by sublimating moisture frozen by cooling an object, and collecting the sublimated moisture with a cold trap, the freeze-drying method comprising:

providing the freeze-drying system according to claim 1;

freezing performed through cooling through a plurality of stages including cooling a freeze-drying chamber via the third refrigerant to a first temperature by setting the freeze-drying chamber to the first temperature, supercooling moisture contained in the object in the freeze-drying chamber to generate an ice nucleus, then cooling the freeze-drying chamber via the third refrigerant to a second temperature lower than the first temperature by setting the freeze-drying chamber to the second temperature using an air cycle, and growing the ice nucleus of the object in the freeze-drying chamber to generate an ice crystal; and drying performed through sublimating the ice crystal formed in the object and collecting the moisture emitted into an atmosphere with the cold trap.

5. The freeze-dry method according to claim 4, wherein cooling in the freeze-drying chamber is facilitated by supplying precooled air into the freeze-drying chamber.

6. The freeze-dry method according to claim 4, wherein air supplied to the freeze-drying chamber is precooled through heat exchange between air taken in from outside and cold generated in the air cycle.

* * * * *